US005673621A

United States Patent [19]

Vaughan

[11] Patent Number: 5,673,621

[45] Date of Patent: Oct. 7, 1997

[54] DRY PALLET FOR HOLDING TEXTILES DURING SILK SCREEN PRINT PROCESS

[76] Inventor: Larry Vaughan, 4 Dane St., Nashua, N.H. 03060

[21] Appl. No.: 614,482

[22] Filed: Mar. 14, 1996

Related U.S. Application Data

[63] Continuation of Ser. No. 329,079, Oct. 25, 1994, abandoned.

[51] Int. Cl.[6] ..... B05C 17/06

[52] U.S. Cl. ..... 101/126

[58] Field of Search ..... 101/115, 126, 101/129, 415.1

[56] References Cited

U.S. PATENT DOCUMENTS

| | | | |
|---|---|---|---|
| 3,568,596 | 3/1971 | Mashburn | 101/415.1 |
| 3,663,980 | 5/1972 | Conklin | 15/215 |
| 4,402,267 | 9/1983 | De Moore | 101/419 |
| 4,739,534 | 4/1988 | Wilson | 15/230.16 |
| 4,899,408 | 2/1990 | Illingworth | 5/484 |
| 5,090,313 | 2/1992 | Chapman | 101/129 |
| 5,174,202 | 12/1992 | Schlichting | 101/129 |

*Primary Examiner*—Ren Yan

*Attorney, Agent, or Firm*—Robert T. Dunn, Pat Atty

[57] ABSTRACT

In textile printing apparatus for printing by a silk screen printing process on a fabric of fleece or cotton pile such as the fabric of sweat shirts or T shirts where the shirt is held on a pallet, a special dry holding plate assembly is attached to the pallet on an area thereof that is immediately adjacent the part of shirt that is to be printed on by the silk screen process for holding the shirt during the process, the plate assembly consisting of a thin plate to which is laminated a plastic film that has molded on the surface thereof a multitude of stems each with a hook at the end thereof, so that each hook catches to fibers of shirt fabric until disengaged by forcible removing the shirt, each stem hook being sufficiently flexibility that it can bend to the force of shirt fabric removal and return to its original shape thereafter, the surface having an array of many hundreds of the stem hooks so that the fabric when placed on the surface and pressed lightly onto it, is engaged by the array of stem hooks and held sufficiently securely for the silk screen printing, followed by removal of the shirt without damage to said shirt fabric.

16 Claims, 3 Drawing Sheets

DRY PALLET FOR HOLDING TEXTILES DURING SILK SCREEN PRINT PROCESS

This application is a continuation of application Ser. No. 08/329,079, filed Oct. 25, 1994, now abandoned.

BACKGROUND OF THE INVENTION

This invention relates method and means of printing on textile clothing made of fleece, cotton or cotton blend fabrics, such as sweat shirts and T shirts, where the shirt is held in place during a silk screen print process of lettering, graphics, logos, etc. on the outside of the shirt.

Items of clothing such as sweat shirts and T shirts are printed with letters, graphics, logos, etc. in one or more colors after the shirt has been made. The printing is usually by a silk screen process, because the cloth surface is soft and fuzzy formed by raised fibers from the underlying material (a nap) or by cut or uncut loops of yarn forming the surface (a pile). Other printing processes are usually not used on such material, because they do not serve near as well as the silk screen process.

Existing equipment for silk screen printing on wool or cotton textile cloths like sweat shirts or T shirts are called panel printers, because the shirt is slipped over a panel (also called a platen or pallet) to hold it and a silk screen box is lowered onto the pallet and operated to print a pattern in one color on the shirt. Such equipment can be simple, manually operated and have a single silk screen box, with or without means for drying the ink. The ink can be allowed to air dry before removing the shirt from the pallet and mounting another shirt for printing.

More likely, the equipment is an automatic shirt panel printer that can print six colors at eight stations (eight pallets) or eight colors at ten stations and is controlled by a special purpose computer. In any case, the shirt is mounted once on a pallet and is printed one or more times. When printing in several colors, the ink must be force dried after each color printing and the shirt must be held at a fixed position on the pallet so that the successive printings are in proper registration to form the desired image. With each cycle in the printing process there is a tendency for the fabric to lift off the pallet. Any movement at all of the fabric will adversely influence the quality of the image. A vacuum system is not workable, so traditionally the fabric is held on the pallet surface with temporary adhesive systems.

Aerosol spray adhesives have been used. When sprayed on the pallet, they provide a tacky surface that will hold the fabric during the print process, but will allow for removal when the printing is finished. The adhesive must be re-applied after each cycle when printing on fleece or every several cycles when printing on light weight cotton and cotton blends. To re-apply the adhesive, first the shirt must be removed from the pallet, then the adhesive sprayed on the pallet and the shirt again mounted on the pallet, being very careful to align the partially printed design on the shirt exactly where is should be on the pallet and ready for the next cycle of printing. This is a time consuming process and often leads to misaligned prints and rejected product. Furthermore, with this technique, after a number of cycles, the pallet surface becomes contaminated with adhesive and must be cleaned and then the entire process repeated.

There are many suppliers of many kinds of adhesives. Most are aerosols in which the adhesive is dispersed in a flammable solvent or methylene chloride. There are bulk adhesive spray system in which the adhesive is applied with manual or automatic spray equipment. There are water activated adhesive films that are applied as liquids and the resultant coating film can be reactivated with water to clean the surface and render the film tacky. Some have even used pressure sensitive films, similar to masking tape, laid down on the pallet tacky side up.

Clearly there is a present need to provide a clean dry surface that will hold the fabric securely as needed (as described above) on the pallet and yet allow for release when the print process is complete. Adhesives and tacky films are not desired, because they have to be renewed so frequently, even during the printing of a single shirt. Liquid or chemical materials can effect the textile material adversely and can contaminate the work place. What is needed is a structure and process and that can be operated for multi-color printing of many shirts without the need to re-apply or re-activate the sticking surface of the pallet.

SUMMARY OF THE INVENTION

It is an object of the present invention to provide method and means of printing on textile wherein the above mentioned problems are avoided.

It is another object of the present invention to provide improved method and means of holding a textile product for printing on the textile.

It is another object of the present invention to provide improved method and means of holding a textile product for printing on the textile by a silk screen technique.

It is another object to provide such an improved method and means of holding a textile product for printing on the textile by a silk screen technique that does not require re-applying the means for holding the textile.

It is another object to provide such an improved method and means of holding a textile product on a pallet for printing on the textile by a silk screen technique that does not require reapplying the means for holding the textile.

It is another object to provide such an improved method and means of holding a textile product on a pallet for printing on the textile by a silk screen technique that permits cleaning the pallet without requiring re-applying the means for holding the textile.

It another object to provide a pallet for holding a textile product securely during a silk screen print process that allows for easy removal of the textile from the pallet without application of any liquid or chemical product.

It is a further object to provide such a pallet to which the textile can be attached and removed many times without solvents, harmful chemicals, flammable liquids or hazardous agents According to embodiments of the present invention a thin plate that may be metal or plastic, is provided with a specially formed mechanical surface that has the ability to attach itself securely to fabric such as fleece or pile cotton, but from which the fabric can be easily removed without damaging the fabric. This plate is called a dry fabric holding plate. It is secured to the pallet on the area thereof immediately adjacent the part of the fabric that is printed on and by simply pressing the fabric against the specially formed mechanical surface the fabric is held securely while being printed on one or more times and when the printing process is completed and the ink dried, the fabric can be removed from the surface and pallet with ease and no damage to the fabric.

In specific embodiments, the textile products are shirts or sweaters such as sweat shirts, T shirts, etc. that are removed when that printing process is complete, allowing the printer to be used for other printing projects.

The dry textile holding plate consists of a thin metal or plastic plate to which has been laminated a plastic film that has been molded on the surface thereof a shape or configuration that has multiple projections that are called stems or hooks and are positioned in an array of rows. Each stem is shaped so that the end or tip is in the form of a curve or hook. Each stem (or hook) has the ability to capture loose fibre from such as fleece or cotton fabric until disengagement by removal of the fabric. Each stem has sufficient flexibility to allow for bending upon the force of fibre removal and is sufficiently resilent that it will return to its original shape thereafter. In a large array on a flat plate, when a sheet of pile fabric is placed onto this surface, that sheet will be engaged and held sufficiently well for operations such as silk screen printing and can be released easily without deformation of the plastic surface or damage to the fabric.

DESCRIPTION OF EMBODIMENTS OF THE INVENTION

According to embodiments of the present invention a thin plate that may be metal or plastic, is provided with a specially formed mechanical surface that has the ability to attach itself securely to fabric such as fleece or pile cotton, but from which the fabric can be easily removed without damaging the fabric. This plate is called the "dry fabric holding plate". It is secured to the pallet on the area thereof immediately adjacent the part of the fabric that is printed on and by simply pressing the fabric against the specially formed mechanical surface of the plate, the fabric is held securely while being printed on one or more times and when the printing process is completed and the ink dried, the fabric can be removed from the surface and pallet with ease and no damage to the fabric.

Figure 1:
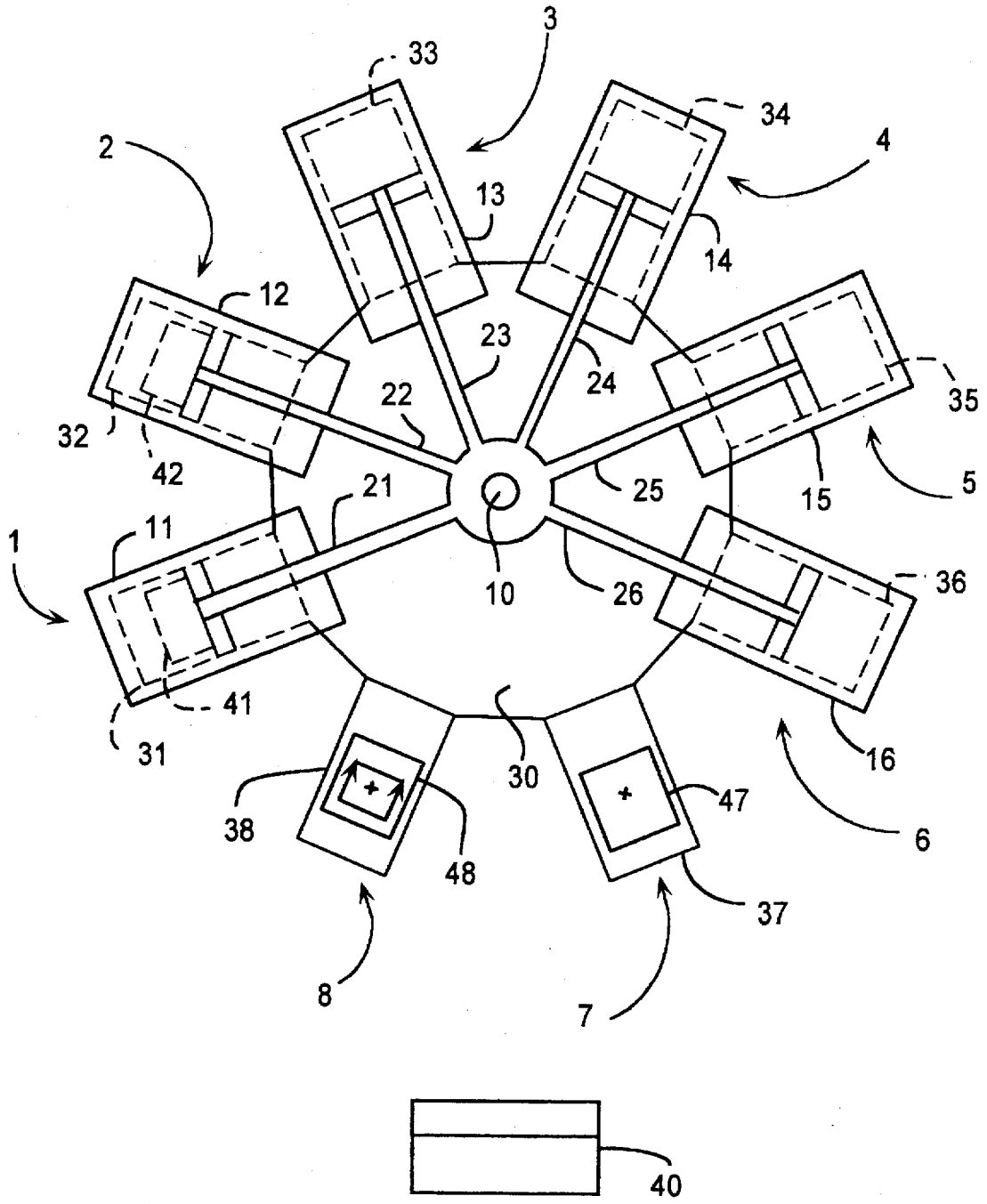
FIG. 1 is a plan view of typical automatic silk screen textile printing apparatus that has eight stations and six silk screen boxes and can be used printing designs on shirts in six colors.

The dry fabric holding plate is used effectively on typical automatic silk screen textile printing apparatus such as shown in FIG. 1, which is a plan view of the apparatus. It prints up to six colors in eight stations. The features of this machine include: automatic pneumatic or hydraulic drives; fine adjustment of each silk screen box squeegee pressure; individually adjustable squeegee stroke length and speed; quick change adjustable pallets; and quick change squeegees.

The computer control for this apparatus offers: run up and run down system for easy start and finish of a print run; possibility of print forward and back stroke or print forward, flood back or flood forward, print back; and multi-stroke capability.

The typical automatic printing apparatus differs from fully manual printers in that the screens automatically come down onto the fabric surface and the squeegee applies the ink automatically and then lifts and the operation moves to the next station. The automatic apparatus usually has more stations than the manual apparatus and is much faster. A well known manufacturer of automatic printing apparatus provides such apparatus for printing up to twelve colors, standard print size 20"×28" or large print size 28"×40". In the operation of some of these the only step that is done manually by the operator is putting the textile (such as a shirt) on a pallet at the beginning of a project and taking it off the pallet at the end of the project. All other steps are automatic and computer controlled.

In the specific embodiments described herein, the textile products are shirts or sweaters such as sweat shirts, T shirts, etc. that are put on the pallets and removed from the pallets manually by the operator.

As shown in FIG. 1, the silk screen printing stations are denoted 1 to 8. Stations 1 to 6 each include a silk screen printing box 11 to 16, suspended by an arm 21 to 26, respectively, from a central support post 10. A pneumatic or hydraulic drive (not shown) is provided that lifts and lowers all of the arms together, lifting the silk screen boxes 11 to 16 off of pallets 31 to 38, respectively, on which the operator has mounted sweat shirts or T shirts for printing. The pallets are carried like spokes of a wheel, on wheel 30. A pneumatic or hydraulic drive (not shown) is provided that rotates wheel 30 around post 10.

In operation, the silk screen boxes are lifted off of the pallets and a shirt to be printed on is mounted on each pallet. This is done at station position 8 by the operator at the computer control 40 by activating the wheel drive to successively move each pallet to station 8 where the operator mounts a shirt on the pallet. When this is done, there is a shirt on every pallet and pallet 31 is at station 1. Then the operator activates the printing process at the computer control and silk screen printing boxes 11 to 16 are automatically lowered at stations 1 to 6 and the printing process at each is automatically carried out. That process varies for each project and may be that each box prints a different color of a six color image or each box prints a different single color image, or any variation thereof. After this printing process, the boxes 11 to 16 are raised from the pallets a brief step of drying the ink by convection and/or radiation is carried out by equipment not shown. Then the wheel is rotated clockwise for the next step, depending on the project.

If the project is to print the same six color image on all shirts, the next step rotates the wheel placing the pallets at the next clockwise station: pallet 38 to station 1; pallet 30 to station 2; pallet 32 to station 3, etc. This automatic sequence of printing, lifting, drying, rotating, lowering and printing continues until pallet 31 arrives at station 7 and the shirt thereon has a complete six color image printed thereon. That shirt is then manually removed from the pallet and a new shirt is mounted thereon and the process continues. At each index of rotation, a completed shirt is removed and a new shirt is added for printing.

Clearly, many different programs (projects) can be carried out by the apparatus and less than all of the silk screen boxes can be lowered and activated at one time and the pallet wheel may rotate more than one station at a time to print anything from one six color image on all shirts to different one color images on the shirts. The project program at the computer 40 is variable.

In all operations, whether with automatic apparatus as shown in FIG. 1 or with single pallet, totally manual apparatus, a shirt is mounted on a pallet manually and must be held there securely at a predetermined position without shifting or creasing throughout one or more printing and drying steps and then it must be removed from the pallet without damage to the fabric or distorting the image printed thereon.

Figure 2:
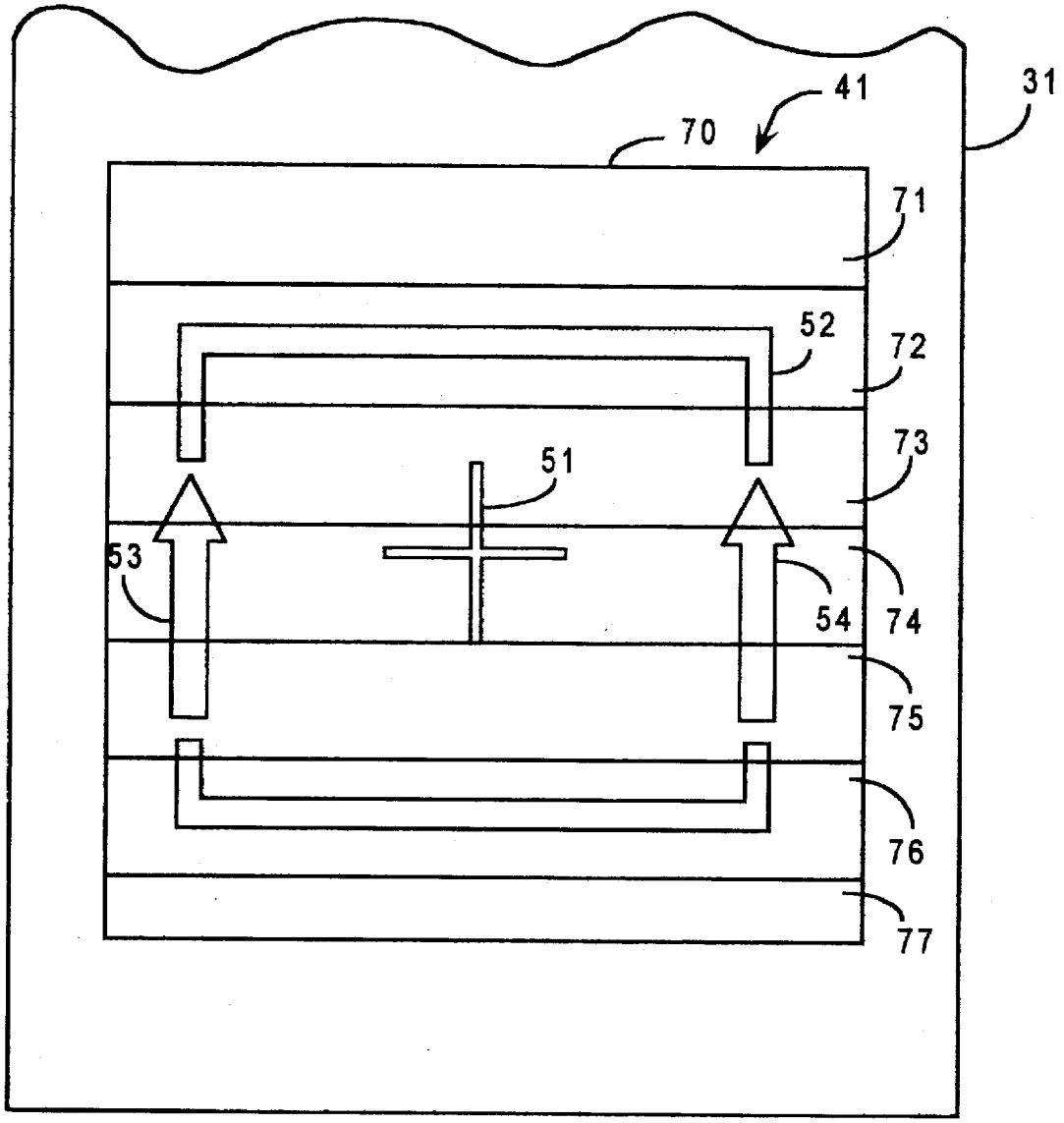
FIG. 2 is a plan view of one of the pallets of the apparatus that is equipped with a dry fabric holding plate according to the present invention.
Figure 3:
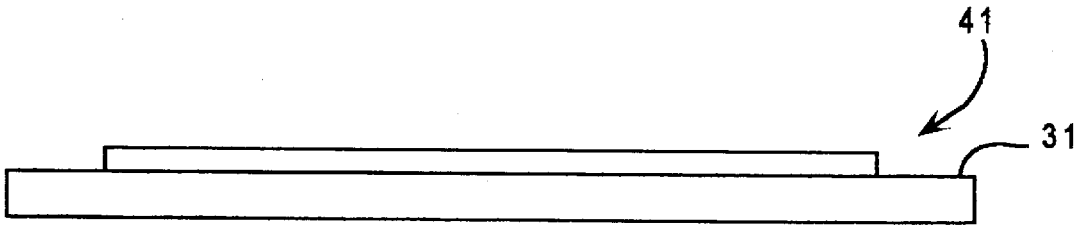
FIG. 3 is an end view of one of the pallet and the dry fabric holding plate attached thereto according to the present invention.

According to the present invention a "dry fabric holding plate" is attached to the top surface of each pallet as shown in FIGS. 1, 2 and 3. In FIG. 1, dry fabric holding plates 41 to 48 are attached to pallets 31 to 38, respectively. Each dry fabric holding plate may have a design thereon to aid the operator in aligning the shirt that is mounted on the pallet. As shown in FIG. 2, dry fabric holding plate 41 has cross lines 51 at the center and a target area defined by square lines 52 with arrows 53 and 54 showing the direction of easy removal of the shirt from the pallet.

Figure 4:
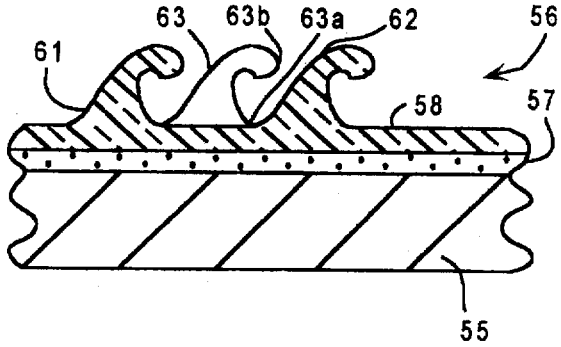
FIG. 4 is a very much enlarged cross-section view of the dry fabric holding plate showing the hooks on the surface thereof.
Figure 5:
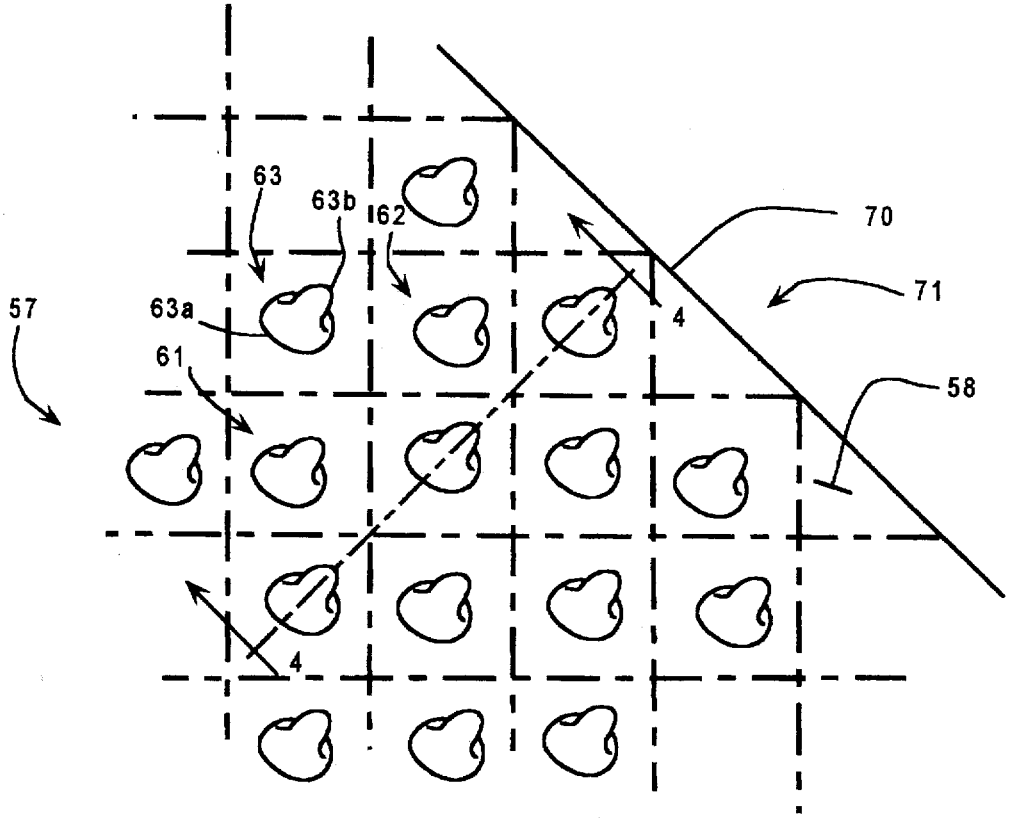
FIG. 5 is a very much enlarged plan view of a portion of the surface of the dry fabric holding plate showing the array of rows of hooks on the surface thereof.

A portion of dry textile holding plate 41 shown in FIGS. 1 to 3 is shown greatly enlarged in FIGS. 4 and 5. It consists of a thin metal or plastic plate 55 to which has been laminated a plastic film 56 by adhesive 57. The plastic film has molded on the surface 58 thereof a shape or configuration that has multiple projections, such as 61, 62 and 63 that are called stems or hooks and are positioned in an array of rows as shown in FIG. 5. Each stem is shaped so that the end or tip is in the form of a curve or hook. Each stem (or hook) catches to loose fibers from textiles such as fleece or cotton pile fabric until disengaged by forcible removing the fabric. Each stem has sufficient flexibility that it can bend to the force of fabric removal and is sufficiently resilient will return to its original shape thereafter. A large array of such stems (hooks) on a flat plate is shown in FIG. 5. When a sheet of pile fabric is placed on this surface and pressed lightly onto it, the sheet of fabric is engaged by many hundreds of the small stems over the area of the sheet and held sufficiently secure for silk screen printing and can be removed easily without deformation of the plastic surface or damage to the fabric.

The stems (or hooks) are very uniform in size and uniformally spaced. They are typically about 0.035 inches high and the density is about 750 per square inch of surface and ribbons of the film are available up to four inches wide, with or without adhesive backing.

In FIG. 5 the edge of such a ribbon of the film is denoted 70. FIG. 4 shows a typical cross-section of the film, denoted 4—4 in FIG. 5. The ribbon carries the stems as shown in FIG. 5, with all stems hooks oriented the same in a direction perpendicular to the edge 70 of the ribbon. The ribbon is attached to the plate by adhesive 57 that may be applied to the plate at the time of attachment of the film to the plate, or may be the adhesive backing on the ribbon of film, covered by a peel-off strip that is removed and discarded at the time of attachment.

As shown in FIG. 2 several lengths of such ribbon of the film are attached to the plate, side by side, all with their stems pointing in the same direction. That direction is called the "easy removal direction" and is indicated by the arrows 53 and 54. For example, in FIG. 2, there are shown seven lengths (strips) 71 to 77 of the ribbon of the film of which six are the same width and the seventh (77) is narrower. Together they comprise the "dry fabric holding surface" 56 attached to the plate 55. This dry fabric holding surface is preferably at least as large an area as the surface area of the fabric that is printed on so that the fabric is held on the pallet uniformally over the entire area thereof that is printed on.

With proper use and maintenance, the "dry fabric holding surface" can last indefinitely. The plates carrying the surface can be removed from the pallets when other types of textile or fabric that will not stick to the surface are being printed. The plates should lay flat on the pallet and may be secured with pallet adhesive or strips of double coated tape.

The holding force between the dry fabric holding surface and the fabric is greatest when the fabric is held against the surface and an effort is made to slide it off of the surface in the direction opposite the easy direction (the direction the hooks are facing). In the other hand, the force is less when the effort is to slide or peel the fabric off in the easy direction. The arrows 53 and 54 may be pointed in any direction and the ribbons of film laid down on the plate accordingly and, of course the plate may be attached to the pallet with the arrows thereon pointing in any direction. The best direction will depend on the personal technique used by the operator to mount and remove the fabric. It is suggested that the arrows point away from the operator so that the operator may lift the nearest end of the fabric first and peel it away from the surface by lifting and removing that end forward from the operator's position.

The dry fabric holding surface can be cleaned with water and most any soap or cleaning agents and/or mild solvents such as paint thinner, mineral spirits and alcohol. Abrasive agents, scour pads, wire brushes etc., can damage the surface and should be avoided. When lint builds up on the surface, it can be removed easily with a lint removal brush of the sort used to remove lint from any fabric by simply brushing across the surface in the easy direction.

The film available is usually made of a thermoplastic polymer material that will last indefinitely in normal use and have been used successfully on a continuous basis on pallets employing various makes of flash curing heaters for drying the ink. However, excessive heat can distort the surface and so extended time beyond the normal flash cure period is not advised.

Then stem, (hook) configuration shown in FIGS. 4 and 5 has a staggered array of the stems with respect to lines running in the direction of the hooks (the easy direction)as shown in FIG. 5. This is preferred as ut affords maximum spacing between the stems in the easy direction, while still providing the high density that is preferred. In this example, as mentioned above, the stems are 0.035 inches high and about 750 per square inch. Also the hook part 63*a* turns downward 0.018 inches from the top.

Figure 6:
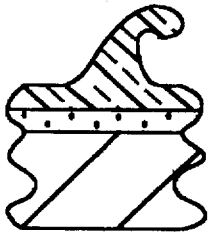
FIGS. 6 and 7 are very much enlarged cross-section views of other shapes of hooks for a dry fabric holding plate according to the present invention.
Figure 7:
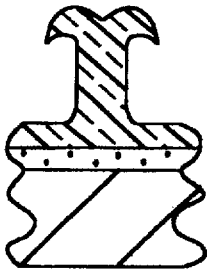

Other configurations of stems for dry fabric holding surfaces that can be used in some applications are shown in FIGS. 6 and 7. For example, the stem configuration in FIG. 6 shows a stem that is 0.050 inches high, has the same hook turn down of 0.018 inches and may be the same density, 750 per square inch. The configuration shown in FIG. 7 is even higher, has two hooks in opposite direction and no really easy direction.

CONCLUSIONS

While the invention is described herein in connection with preferred embodiments, it will be understood that it is not intended to limit the invention to those embodiment. It is intended to cover all alternatives, modifications, equivalents and variations of those embodiments and their features as may be made by those skilled in the art within the spirit and scope of the invention as defined by the appended claims.

I claim:

1. A textile printing apparatus for printing by a silk screen process on a fabric that is made of fibers and is held on a pallet while the printing process is carried out, comprising at least a screen printing squeegee and means for holding said fabric on said pallet, said fabric holding means and comprising, (a) a plate for attachment to said pallet on an area thereof that is immediately adjacent the part of said fabric that is to be printed on by said silk screen process, b) said plate consists of a thin metal or plastic plate to which has been laminated a plastic film that has molded on the surface thereof a configuration that has a multitude of identical, flexible, resilient projecting stems, that are positioned in an array on said plate surface, c) each stem including a base molded on said plastic film surface and a projecting end arising from said base, (d) each stem is tapered from said base to said projecting end thereof, (e) each stem projecting end being shaped in the form of a hook, (f) each stem projecting end, projecting toward said fabric a sufficient distance to catch to said fabric placed thereagainst and (g) said array of stems holds said fabric so placed for printing thereon and from which said fabric can be easily removed without damaging said fabric.

2. Textile printing apparatus as in claim 1 wherein, (a) said stem hooks of said array of stems are all oriented the same on said surface and define the direction for easy removal of said fabric from said surface.

3. Textile printing apparatus as in claim 2 wherein, (a) said direction for easy removal of said fabric from said surface is the direction of said hooks.

4. Textile printing apparatus as in claim 3 wherein, (a) said stem hooks of said array of stems define parallel lines along which said stems are regularly spaced.

5. Textile printing apparatus as in claim 4 wherein, (a) said stem hooks of said array of stems along said parallel lines are staggered with respect to the stem hooks along the immediately adjacent parallel line as viewed perpendicular to said parallel lines.

6. Textile printing apparatus as in claim 4 wherein, (a) said stems of said array of stems each have a base where they meet said plastic film, said stem bases are all the same and are spaced apart equally in equal rows and columns.

7. Textile printing apparatus as in claim 6 wherein, (a) said stem bases equal rows and columns are perpendicular to each other and at an acute angle to said easy direction.

8. Textile printing apparatus as in claim 7 wherein, (a) said stems are not more than 0.1 inches high and there are not less than 500 of them per square inch of said surface.

9. A textile printing apparatus for printing by a silk screen process on a fabric of fleece or cotton pile that is held on a pallet, comprising at least a screen printing squeegee and means for holding said fabric on said pallet, said fabric holding means comprising, (a) a plate assembly for attachment to said pallet on an area thereof that is immediately adjacent the part of said fabric that is to be printed on by said silk screen process and (b) said plate assembly consists of a thin plate to which is laminated a plastic film that has molded on the surface thereof a multitude of flexible, resilient stems, that are positioned in an array on said plate surface, (c) each stem including a base molded on said plastic film surface and a projecting end arising from said base, (d) each stem being tapered from said base to said projecting end thereof, (d) each stem projecting end being shaped in the form of a hook, (e) each stem projecting end, projecting toward said fabric a sufficient distance that said hook thereof catches to said fabric placed thereagainst and (f) each of said stem hooks has sufficient flexibility that it can bend to the force of fabric removal and is sufficiently resilient that it will return to its original shape thereafter, (g) there being an array of many hundreds of said stem hooks per square inch on said surface that engage fibers of said fabric and hold said fabric sufficiently secure on said pallet for silk screen printing on said fabric, followed by removal of said fabric without damage to said fabric.

10. Textile printing apparatus as in claim 9 wherein, (a) said stem hooks of said array of stems are all oriented the same on said surface and define the direction for easy removal of said fabric from said surface.

11. Textile printing apparatus as in claim 10 wherein, (a) said direction for easy removal of said fabric form said surface is the direction of said hooks.

12. Textile printing apparatus as in claim 11 wherein, (a) said stem hooks of said array of stems define parallel lines along which said stems are regularly spaced.

13. Textile printing apparatus as in claim 12 wherein, (a) said stem hooks of said array of stems along said parallel lines are staggered with respect to the stem hooks along the immediately adjacent parallel line as viewed perpendicular to said parallel lines.

14. Textile printing apparatus as in claim 12 wherein, (a) said stems of said array of stems each have a base where they meet said plastic film, said stem bases are all the same and are spaced apart equally in equal rows and columns.

15. Textile printing apparatus as in claim 14 wherein, (a) said stem bases equal rows and columns are perpendicular to each other and at an acute angle to said easy direction.

16. Textile printing apparatus as in claim 15 wherein, (a) said stems are not more than 0.1 inches high and there are not less than 500 of them per square inch of said surface.

* * * * *